US006996850B2

(12) United States Patent
Tanaka

(10) Patent No.: US 6,996,850 B2
(45) Date of Patent: Feb. 14, 2006

(54) JACKET FOR BASEBALL

(76) Inventor: Tsuguya Tanaka, 4-5, Hattorihonmachi 1-chome, Toyonaka-shi, Osaka (JP)

( * ) Notice: Subject to any disclaimer, the term of this patent is extended or adjusted under 35 U.S.C. 154(b) by 147 days.

(21) Appl. No.: 10/767,736

(22) Filed: Jan. 30, 2004

(65) Prior Publication Data

US 2005/0166300 A1 Aug. 4, 2005

(51) Int. Cl.
*A41B 1/12* (2006.01)

(52) U.S. Cl. ..... 2/71

(58) Field of Classification Search ..... 2/2.5, 2/92, 94, 69, 108, 70, 115, 71, 72, 114.86
See application file for complete search history.

(56) References Cited

U.S. PATENT DOCUMENTS 1,825,197 A * 9/1931 McGinnis ..... 2/86
2,959,788 A * 11/1960 Justad ..... 2/86
3,147,491 A * 9/1964 Fisch ..... 2/86
4,467,476 A * 8/1984 Herbert ..... 2/2.5
5,101,511 A * 4/1992 Elverskog ..... 2/2.5
6,108,815 A * 8/2000 Majerfeld ..... 2/71
6,804,834 B1 * 10/2004 Mok ..... 2/329

FOREIGN PATENT DOCUMENTS

JP Y 6-69215 7/1994
JP 9122288 5/1997
JP 2000-303221 10/2000

* cited by examiner

*Primary Examiner*—Tejash Patel

(57) ABSTRACT

An object of the invention is to prevent entry of sand on a ground into a portion between an outside face of a lower portion of a jacket body of a jacket for baseball and an inside face near a waist belt of bottoms for baseball at the moment of headfirst sliding. An upper end portion of a cover sheet surrounding a trunk portion of a body is sewed and fixed on the lower portion and an inside of the jacket body. An upper portion of the bottoms for baseball and the waist belt are covered by the lower portion the jacket body and the cover sheet is fastened on a trunk portion via the upper portion of the bottoms for baseball by the waist belt.

9 Claims, 7 Drawing Sheets

JACKET FOR BASEBALL

BACKGROUND OF THE INVENTION

1. Field of the Invention

The present invention relates to a jacket for baseball such as a uniform jacket for baseball and a uniform shirt for baseball.

2. Description of the Related Art

During playing baseball sliding is frequently performed. In sliding, especially headfirst sliding, sand on a ground gets into a portion between a lower portion of a uniform jacket for baseball and an upper portion provided with a waist belt of pants. This often causes interruption of the baseball game.

Japanese Unexamined Patent Publication JP-A 9-122288 (1997) discloses a related art for solving the above-mentioned problem. In the related art, a cloth for covering portions from an intermediate portion of a uniform jacket such as a uniform jacket for baseball to a belt of uniform pants is attached to the uniform jacket and pants with a fastening tape under the trade name "Magic Tape" ("Magic Tape" is a registered trademark) and thereby entry of sand from the upper portion into the inside of the uniform pants is prevented.

In the related art, since the cloth is provided in front portions of the uniform jacket and pants, the cloth is apt to be conspicuous and is of poor sense of beauty. Furthermore, in sliding, the cloth comes in frictional contact with a surface of the ground and thereby there is possibility that the Magic Tape or the cloth comes off from the uniform jacket and pants. Further, there is possibility that a player neglects to attach the cloth to the uniform jacket and pants.

SUMMARY OF THE INVENTION

An object of the invention is to provide a jacket for baseball which is improved so as to prevent entry of sand or the like from an upper portion into an inside of pants at the moment of headfirst sliding or the like during playing baseball.

The invention provides a jacket for baseball comprising:

a jacket body; and a cover sheet extending in a circumferential direction of the jacket and having an upper end attached to an inside of at least a front part of a lower portion of the jacket body and having a lower end extending to below a hem of the jacket body, wherein the jacket body and the cover sheet are constituted so that a waist belt of bottoms for baseball can be located on a region from an attaching portion for the cover sheet of the lower portion of the jacket body to the hem of the jacket body in a vertical direction of the jacket body and between an inside face of the lower portion of the jacket body and an outside face of the cover sheet.

Furthermore, the invention provides a jacket for baseball comprising:

a jacket body; and a cover sheet having an upper end attached to an inside of at least a front part of a lower portion of the jacket body, wherein the jacket body and the cover sheet are constituted so that a waist belt of bottoms for baseball can be located on a region from an attaching portion for the cover sheet of the lower portion of the jacket body to the hem of the jacket body in a vertical direction of the jacket body and between an inside face of the lower portion of the jacket body and an outside face of the cover sheet.

The cover sheet is attached to the jacket body by sewing the upper end of the cover sheet to the inside of a portion near and upper from the hem of at least the front part of the jacket body of a jacket such as a uniform jacket for baseball or a uniform shirt for baseball which front is at least near a front body of the jacket body, and the lower end of the cover sheet extends long to below the hem of the jacket body. A waist belt arranged on an upper portion of bottoms for baseball such as uniform trousers for baseball and pants for baseball fastens an upper portion of bottoms for baseball and the cover sheets on a trunk portion of a baseball player's body. A lower portion of the jacket body covers the waist belt and the upper portion of the bottoms for baseball on which the waist belt is arranged from the outside thereof.

Consequently, for instance at the moment of headfirst sliding during playing baseball, the lower portion of the jacket body covers the upper portion of the bottoms for baseball and therefore there is no possibility that sand on the ground gets into the upper portion of the bottoms for baseball. Since the cover sheets are fastened in the inside of the upper portion of the bottoms for baseball by the waist belt, the lower portion of the jacket body is restrained from swinging and flapping according to motion of a baseball player.

Since the lower ends of the cover sheets extend to below the hem of the jacket body, the cover sheet is securely fastened by the waist belt even if the jacket body is moved to an upper direction of the player's body, a state where the cover sheet is fastened by the waist belt is kept.

In another embodiment of the invention, the lower end of the cover sheet may exist on an approximately the same vertical position as the hem of the jacket body, or the lower end of the cover sheet may exist above the hem of the jacket body.

Since the cover sheet is arranged in the inside of the jacket body, the cover sheet is never seen from the outside and increased sense of beauty can be achieved. Furthermore, since the cover sheet is attached to the jacket body, the cover sheet is attached in a state where the jacket body is worn and entry of sand into the upper portion of the bottoms for baseball is always prevented.

In the invention, the cover sheet is formed over substantially a whole circumference of the jacket for baseball.

According to the invention, the cover sheet may be formed over substantially the whole circumference of the jacket for baseball, but in another embodiment of the invention, the cover sheet may be arranged on at least the front part of the jacket for baseball and thereby entry of sand into the upper portion of the bottoms for baseball is prevented in headfirst sliding.

Furthermore, in the invention, a vertical length between the attaching portion of the cover sheet to the lower portion of the jacket body and the hem of the jacket body is approximately 20 to 40 cm.

The cover sheet droops by a length of L1 equal to approximately 20 to 40 cm from the attaching portion to the lower portion of the jacket body and thereby the cover sheet is kept in a state where the cover sheet is always fastened by the waist belt at the moment of motion of a baseball player and does not have disadvantage for the motion and there is no unpleasant feeling for the baseball player on attaching the cover sheet.

Furthermore, in the invention, a material of the cover sheet is thinner than that of the jacket body.

Furthermore, in the invention, a surface of the material of the cover sheet has a friction coefficient smaller than that of a surface of the material of the jacket body.

The material of the cover sheet is thinner than that of the jacket body and thereby motion of the baseball player is performed more smoothly and the cover sheet does not have disadvantage for the motion. The material of the jacket body is configured by knitting chemical fiber such as polyester thread or the like without clearance and thickly by a Raschel knitting machine, a circular knitting machine, a tricot knitting machine or the like so that entry of sand into inside can be prevented and any damage cannot arise by friction at the moment of sliding, and bottoms for baseball are also similarly configured as the jacket body. The cover sheet prevents the lower portion near the hem of the jacket body from lapping and prevents the upper portion of the bottoms for baseball from being greatly spaced to an outside (corresponding to a left direction in FIG. 1) and thereby serves prevention of an obstacle to motion of the baseball player and such a cover sheet prevents something which is obstacle to motion of the baseball player who is a person on which the cover sheet is worn and the cover sheet serves prevention of occurrence of unpleasant feeling. Therefore, the material of the cover sheet may be thin and it is preferable that the cover sheet has characteristics in which friction coefficient of a surface of the material of the cover sheet is small so that the jacket for baseball of the invention can be easily worn. Polyester thread, polyester/cotton mixed thread, cotton, silk or the like may be used as the material of such a cover sheet by using a warp knitting machine such as a Raschel knitting machine or a tricot knitting machine and furthermore the material may be also configured by material having well breathability by which moisture is diffused.

Furthermore, in the invention, the jacket body is of a front opening type, and the cover sheet attached to an inside of at least a front part of each of left and right front bodies and extends in a circumferential direction thereof.

According to the invention, as shown in FIGS. 1 to 4, the cover sheet is attached to the inside of at least the front part of each of left and right front bodies of the jacket body of a front opening type and the cover sheet surrounds a trunk portion of a baseball player or the like continuously in circumferential direction in a state where the jacket body is worn on a body of the baseball player. Consequently, in a state where the jacket body is fixed on a body of the baseball player, the cover sheet surrounds, for instance, substantially the whole circumference of the trunk portion of the body circularly. Thus, the jacket body of the invention may be a uniform jacket for baseball of a front opening type.

Furthermore, in the invention, the jacket body is of a pullover type, and the cover sheet is of an endless circular type.

Furthermore, in the invention, the cover sheet shrinks in the circumferential direction in a natural state and resiliently fastens a trunk portion of a body in a state where the cover sheet is worn on the body.

According to the invention, as shown in after-mentioned FIGS. 5 to 7, the jacket body is of a pull over type and consequently the lower portion of the jacket body is approximately cylindrical and the cover sheet is formed in an endless circular shape corresponding to the shape of such a jacket body. Thus, pull over type of the jacket body is easy to be worn and entry of sand into the inside of the jacket from the upper portion of the bottoms for baseball can be prevented. Thus, the jacket body of the invention may be of a pullover type of uniform shirt for baseball.

The cover sheet includes an elastic braid or the like and the cover sheet shrinks in the circumferential direction in a natural state. Consequently, the cover sheet resiliently touches the waist of the body in a state where the cover sheet is worn. This restrains vertical shifting of the cover sheet from the body and keeps a state where the cover sheet is securely fastened via the upper portion of the bottoms for baseball by the waist belt, and there is no possibility that the cover sheet sticks out to the outside over the upper portion of the bottoms for baseball.

According to the invention, during playing baseball, for instance, in headfirst sliding or the like, sand on the ground is prevented from entering inside through between the outside face of the lower portion of the jacket body and the inside face of the upper portion near the waist belt of the bottoms for baseball and sense of beauty does not have less advantage and also the lower portion of the jacket body is restrained from swinging and flapping during motion of the baseball player and comfortable motion can be maintained.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
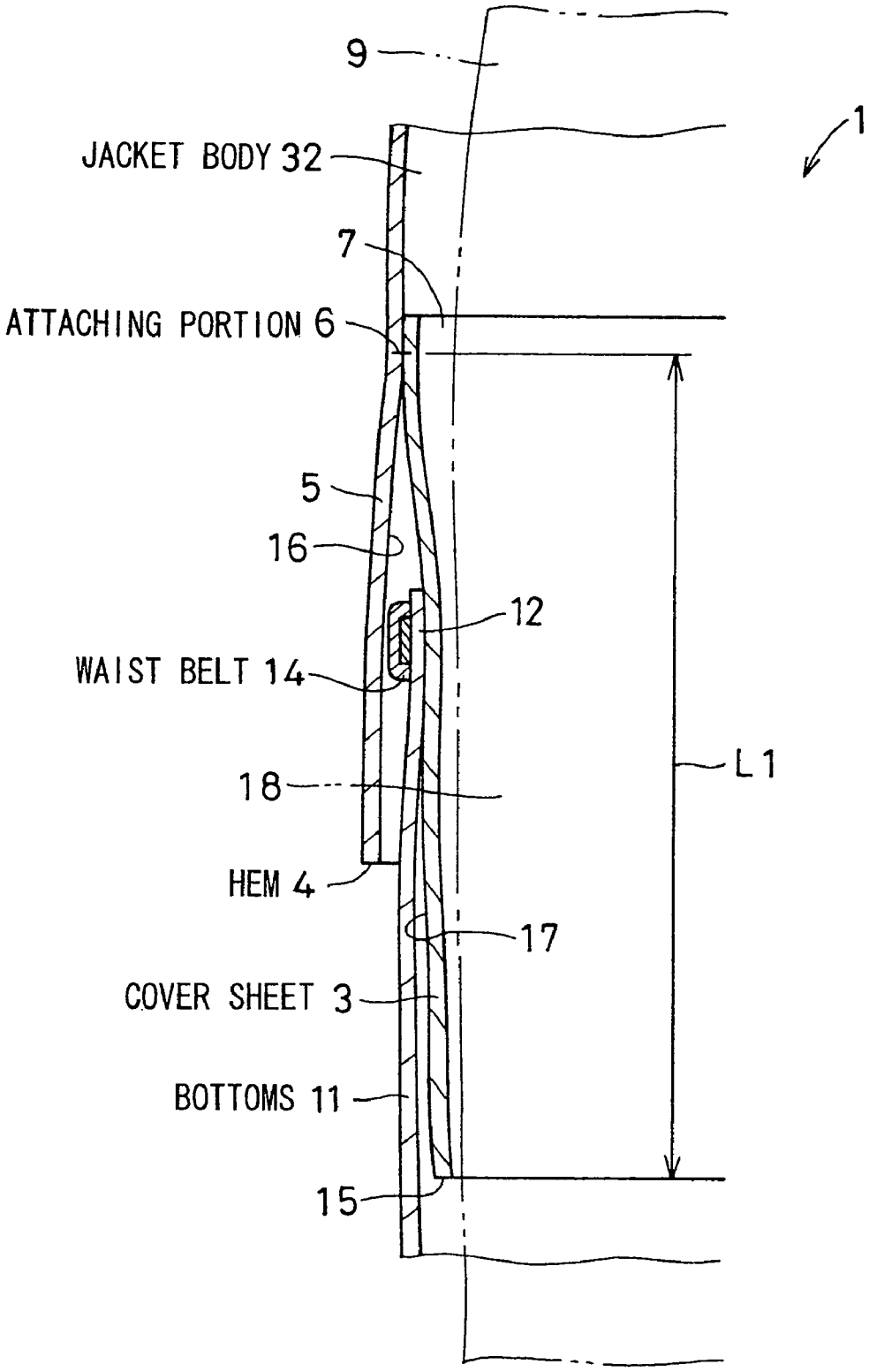
FIG. 1 is a longitudinal sectional view showing a jacket for baseball according to one embodiment of the invention.

Now referring to the drawings, preferred embodiments of the invention are described below.

Figure 2:
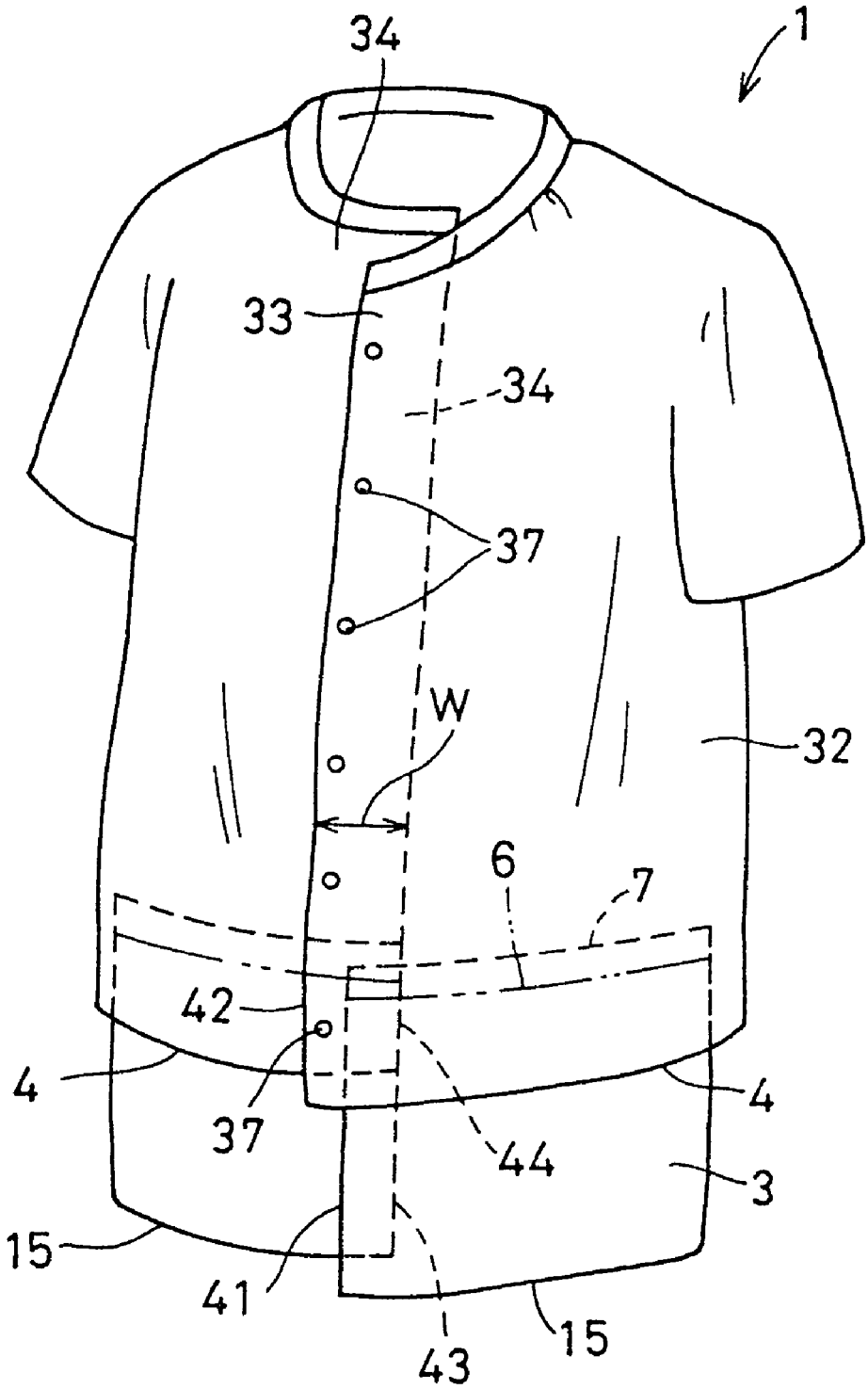
FIG. 2 is a perspective view showing the jacket for baseball according to one embodiment of the invention.
Figure 3:
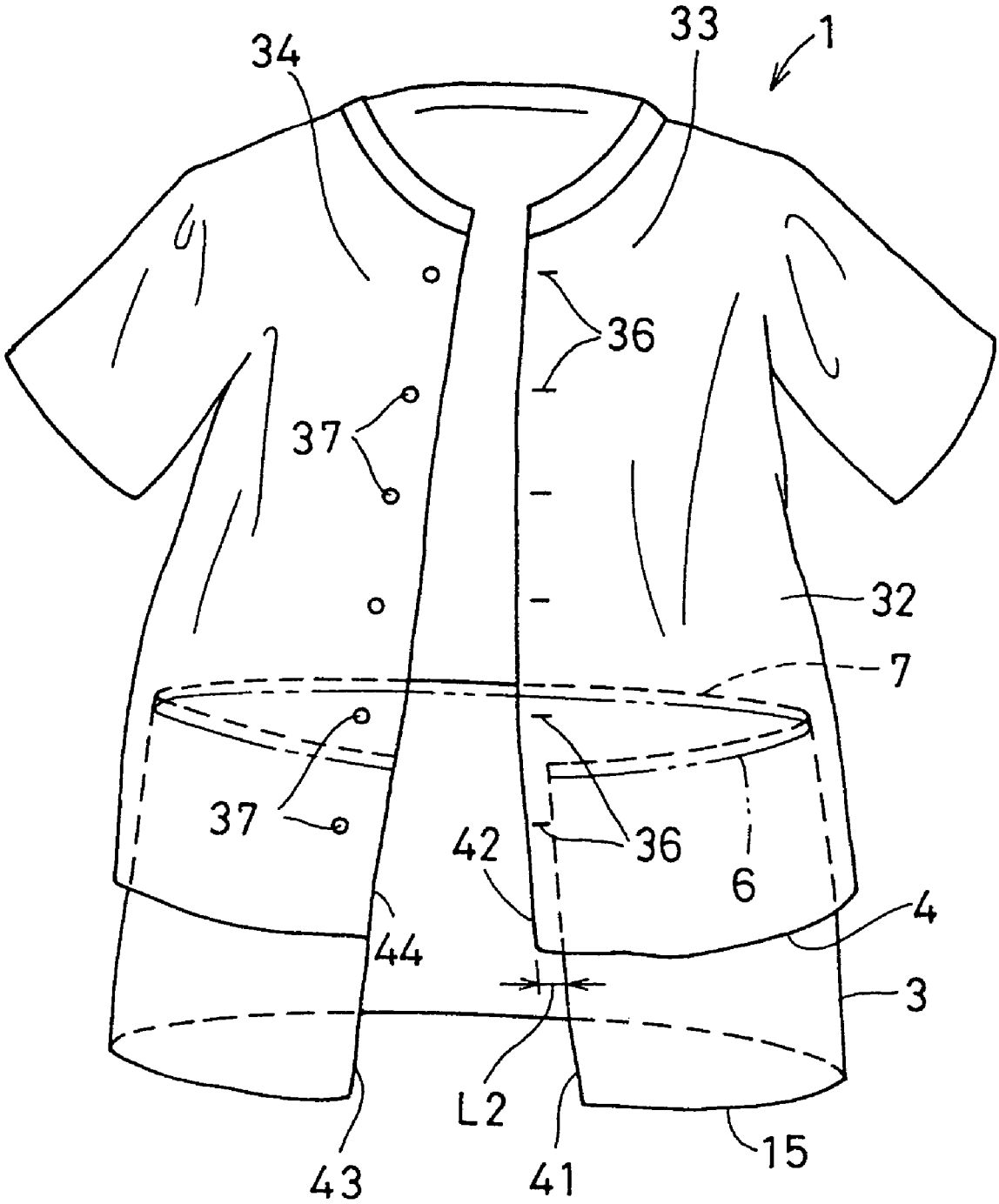
FIG. 3 is a perspective view showing an opening state of the jacket for baseball according to one embodiment of the invention.
Figure 4:
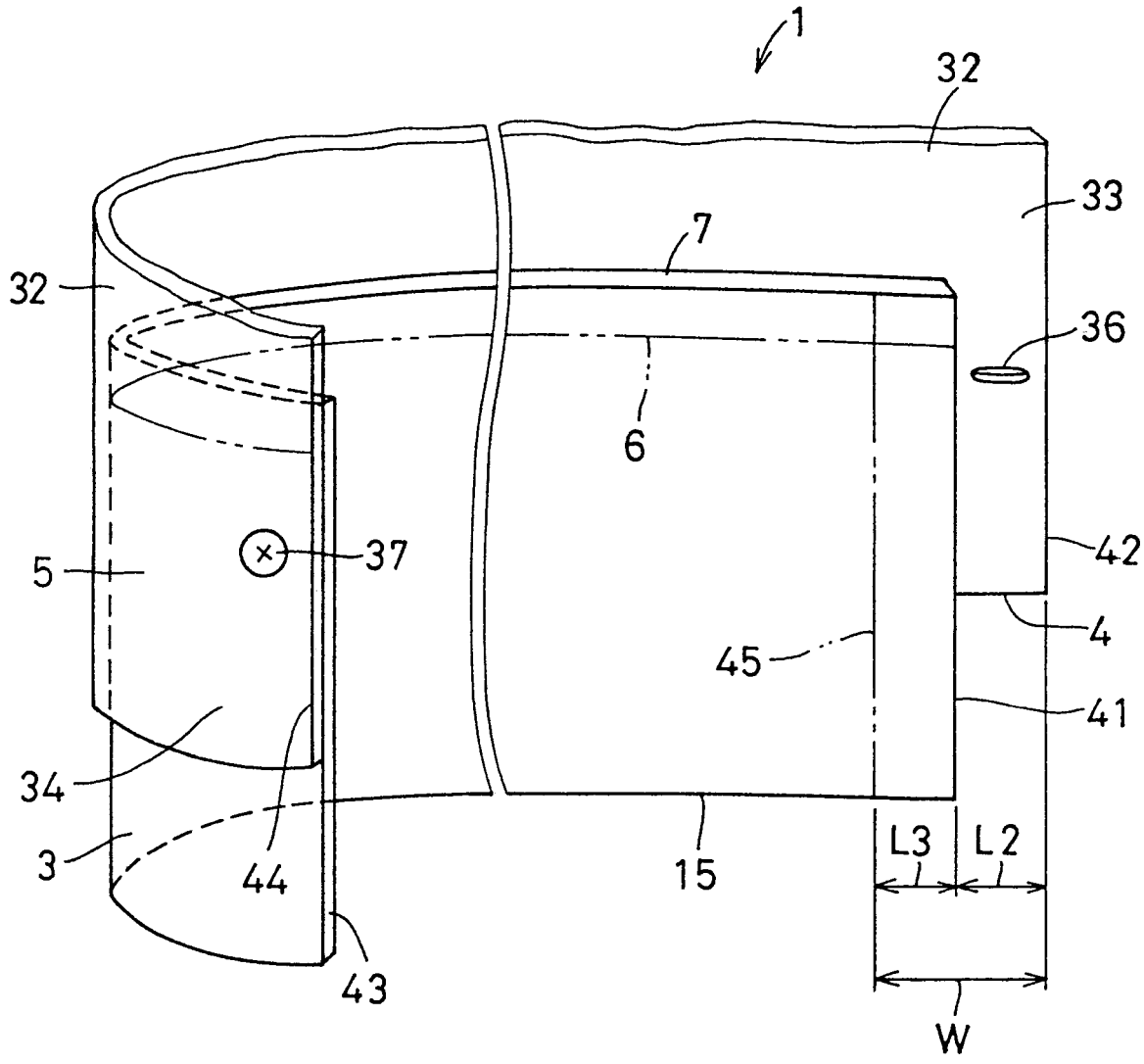
FIG. 4 is a perspective view showing a part of one embodiment of the invention shown in FIGS. 1 to 3.

FIG. 1 is a longitudinal sectional view showing a jacket for baseball 1 according to one embodiment of the invention, FIG. 2 is a perspective view showing the jacket for baseball 1, FIG. 3 is a simplified perspective view showing an opening state of the jacket for baseball 1, and FIG. 4 is a perspective view showing a part of jacket for baseball 1. Referring to these drawings, the jacket for baseball 1 basically comprises a jacket body 32 and a cover sheet 3. The jacket body 32 is of a front opening type jacket and a left front body 33 vertically overlaps a right front body 34 and a front fly breadth W is formed. A button 37 attached to the right front body 34 is detachably fitted into a plurality of buttonholes 36 arranged on upper and lower positions of the left front body 33 to be made connection with each other. Instead of combination of the buttonholes 36 and the button 37, a clamp having another configuration may be used. An upper end portion 7 of the circular cover sheet 3 is sewed by a string or the like and attached on an attaching portion 6 on an inside of the front face of the lower portion 5 which is an upper portion from the body hem 4 near the body hem 4. An upper portion 12 of bottoms for baseball 11 that is a pair of trousers is fastened on a body 9 of the baseball player by a waist belt 14. The upper portion 12 of the bottoms for baseball 11 is covered together with the waist belt 14 by the lower portion 5 of the jacket body 2. The upper portion 12 of the bottoms for baseball 11 and the waist belt 14 exist below the attaching portion 6 of the upper end portion 7 of the cover sheet 3.

A lower end 15 of the cover sheet 3 extends to below the hem 4 of the jacket body 32. The waist belt 14 of the bottoms for baseball 11 is located on a portion in a way of a vertical direction between the attaching portion 6 of the cover sheet 3 to the lower portion 5 of the jacket body 32 and the hem 4 of the jacket body 32 and also located between an inside face 16 of the lower portion 5 of the jacket body 32 and an outside face 17 of the cover sheet 3.

This cover sheet 3 is formed circularly and cylindrically and in a overlapping state on the front fly breadth W over the whole circumference of the jacket body 32, consequently over the whole circumference of a trunk portion 18 of the baseball player's body 9 as mentioned above. The vertical length L1 between the attaching portion 6 and the lower end portion 15 of the cover sheet 3 is approximately 20 to 40 cm, preferably approximately 25 to 35 cm, and more preferably approximately 30 cm. This keeps a state where the cover sheet 3 is fastened on the trunk portion 18 of the body 9 by the waist belt 14, and there is no possibility that the cover sheet 3 sticks out to the outside (corresponding to the left direction in FIG. 1) over the upper portion 12 of the bottoms for baseball 11.

One end portion 41 of the cover sheet 3 in a circumferential direction is located with an interval of a length L2 in the circumferential direction from an front end portion 42 of the front body 33. Another end portion 43 of the cover sheet 3 in the circumferential direction is located on the same position in the circumferential direction as an end portion 44 of the right front body 34. The attaching portion 6 may be located above the buttonhole 36 and the button 37 in the lowermost position. As shown in FIG. 4, another end portion 43 of the cover sheet 3 is located and overlapped with an interval of a length L3 in the circumferential direction from the one end portion 41 of the cover sheet 3 as denoted by a reference numeral 45. Thus the length of the front fly breadth W is a sum of the lengths L2 and L3 (W=L2+L3) in FIG. 4. Providing overlapped length L3 can prevent the jacket body 32 from swinging and flapping from the bottoms for baseball 11 to the outside.

The jacket body 32 is configured by knitting chemical fiber such as polyester thread or the like without clearance and thickly by using a Raschel knitting machine, a circular knitting machine, a tricot knitting machine or the like so that sand can be prevented from entering into an inside of the jacket body 32 from a space between materials at the moment of sliding and damage cannot arise by action of strong friction at the moment of sliding. The material of the cover sheet 3 is thinner than that of the jacket body 32 and has characteristics in which friction coefficient of a surface of the material of the cover sheet 3 is smaller than that of a surface of the material of the jacket body 32. Even when the cover sheet 3 intervenes between the upper portion 12 of the bottoms for baseball 11 and the trunk portion 18 of the body 9 and is fastened by the waist belt 14, unpleasant feeling never arises and the baseball player feels comfort and can perform hard motion comfortably and there is no possibility that the motion is hindered by the cover sheet 3. The material of the cover sheet 3 may be configured by knitting, for instance, chemical fiber, for instance, polyester thread by using a warp knitting machine such as a Raschel knitting machine, a circular knitting machine, a tricot knitting machine or the like and furthermore, a great number of openings making breathability well may be formed so that moisture can be diffused and there can be no unpleasant feeling.

The cover sheet 3 is woven by an elastic braid or the like and thereby the cover sheet 3 shrinks in the circumferential direction in a natural state and may be configured so that the trunk portion 18 of the body 9 can be resiliently fastened in the inside (corresponding to the right direction of FIG. 1) in a state where the cover sheet 3 is worn on the body 9. Such a resilient force more reliably prevents the cover sheet 3 from vertically shifting from the trunk portion 18 of the body 9.

Figure 5:
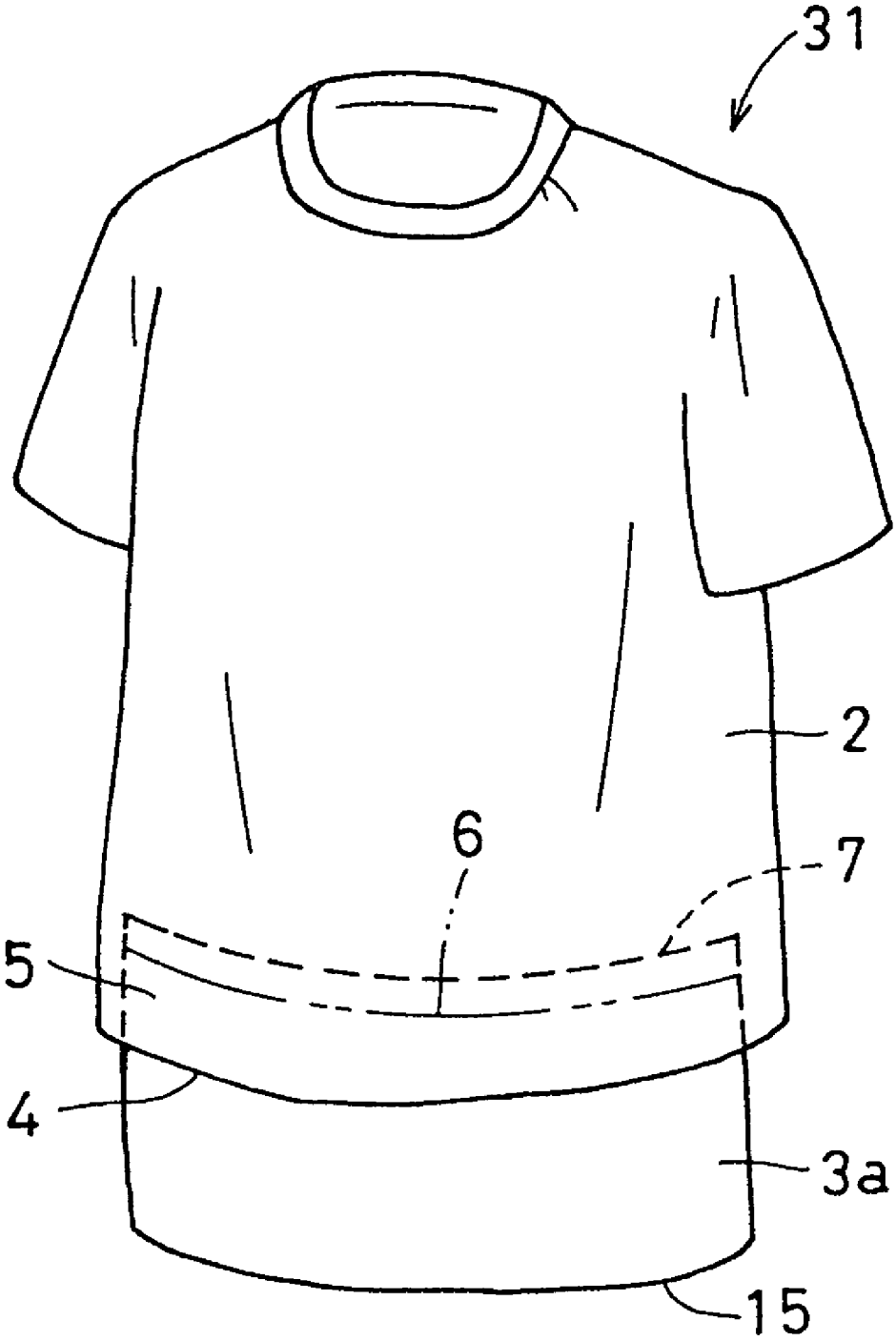
FIG. 5 is a perspective view showing a part of a jacket for baseball according to another embodiment of the invention.

FIG. 5 is a front perspective view showing a jacket for baseball 31, viewed from a front side according to further another embodiment of the invention. This jacket for baseball 31 is similar to each embodiment mentioned above in the FIGS. 1 to 4 and a corresponding portion is denoted by the same reference numeral and moreover there is a case where a subscript "a" is attached to the reference numeral. The jacket body 2 of the jacket for baseball 31 that is a uniform shirt for baseball is of a round-necked, short-sleeved, collarless and pullover type.

Figure 6:
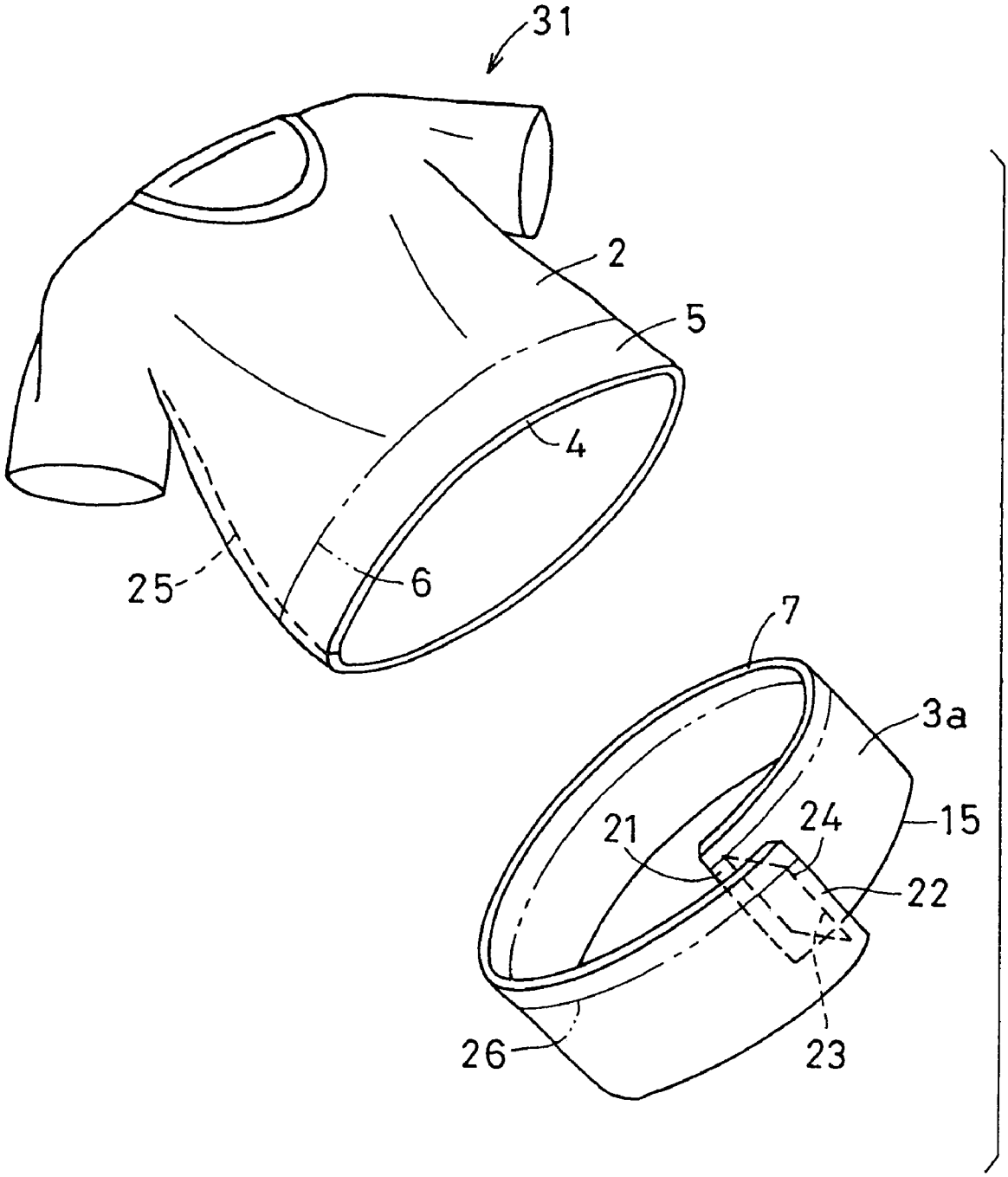
FIG. 6 is an exploded perspective view showing the jacket for baseball shown in FIG. 5.

FIG. 6 is an exploded perspective view showing the jacket for baseball 31 shown in FIG. 5. The cover sheet 3 is an endless circular shape by sewing both ends 21 and 22 of long belt with thread 23 and a combined portion 24 made with the thread 23 may coincide with a combined portion 25 of the jacket body 2 in circumferential direction. The attaching portion 6 of the lower portion 5 of the jacket body 2 is sewed by a thread and fixed on the portion of reference numeral 26 of the cover sheet 3 in FIG. 3.

Figure 7:
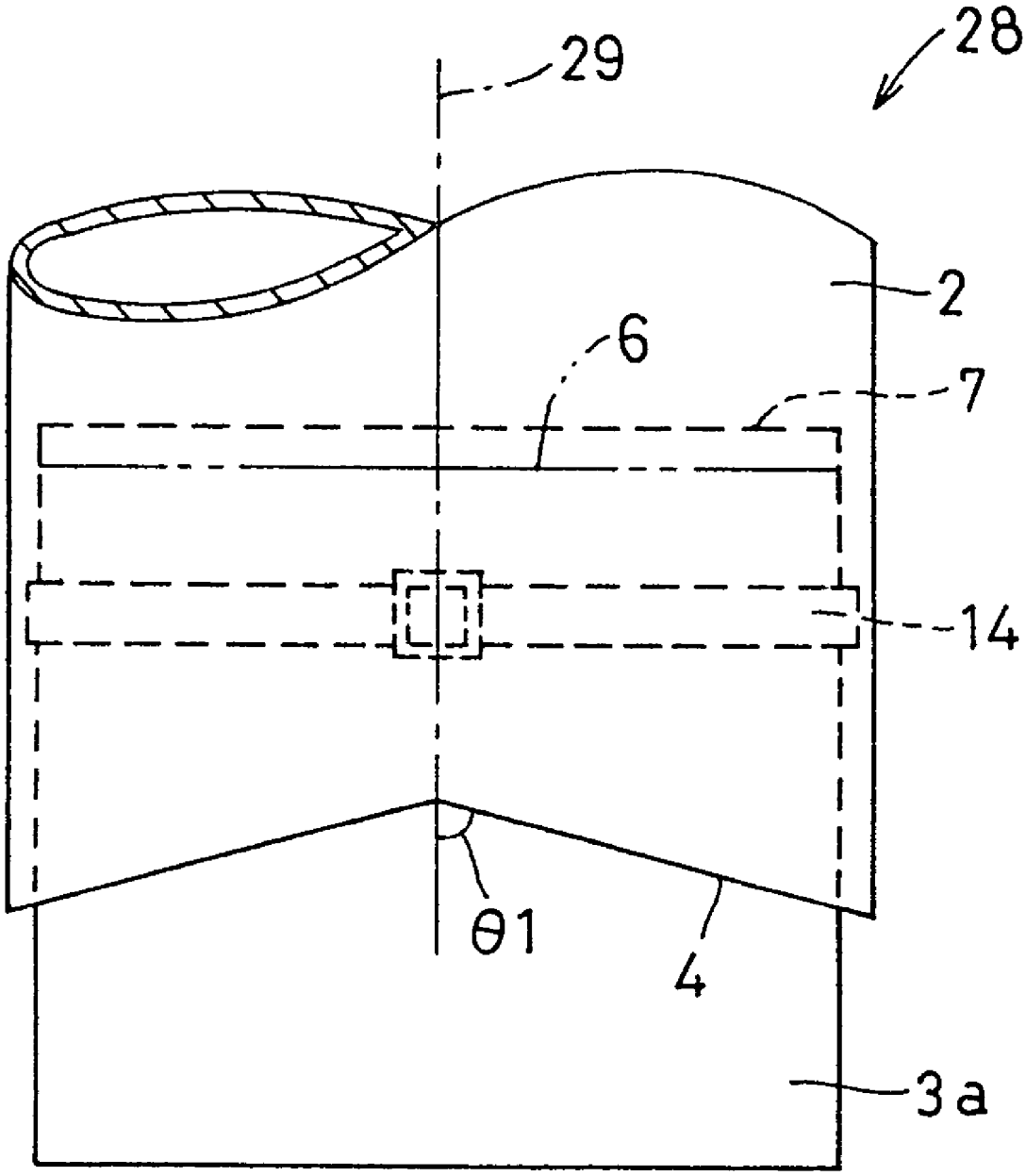
FIG. 7 is a perspective view showing a jacket for baseball, viewed from a front side according to another embodiment of the invention.

FIG. 7 is a perspective view showing a part of a jacket for baseball 28 according to another embodiment of the invention. The hem 4 of the jacket body 2 may not be perpendicular to a vertical axis line 29 and may be tilted at an angle of θ1 and may be another shape. Other configuration of the embodiment shown in FIG. 7 is similar to the embodiment in FIGS. 5 and 6 mentioned above.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A jacket for baseball comprising:

a jacket body; and a cover sheet extending in a circumferential direction and having an upper end attached to an inside of at least a front part of a lower portion of the jacket body and having a lower end extending to below a hem of the jacket body, wherein the jacket body and the cover sheet are constituted so that a waist belt of bottoms for baseball can be located on a region from an attaching portion for the cover sheet of the lower portion of the jacket body to a hem of the jacket body in a vertical direction of the jacket body and between an inside face of the lower portion of the jacket body and an outside face of the cover sheet.

2. The jacket for baseball of claim 1, wherein the cover sheet is formed over substantially a whole circumference of the jacket for baseball.

3. The jacket for baseball of claim 1, wherein a vertical length between the attaching portion of the cover sheet to the lower portion of the jacket body and the hem of the jacket body is approximately 20 to 40 cm.

4. The jacket for baseball of claim 1, wherein a material of the cover sheet is thinner than that of the jacket body.

5. The jacket for baseball of claim 1, wherein a surface of the material of the cover sheet has a friction coefficient smaller than that of a surface of the material of the jacket body.

6. The jacket for baseball of claim 1, wherein the jacket body is of a front opening type, and the cover sheet attached to an inside of at least a front part of each of left and right front bodies and extends in a circumferential direction thereof.

7. The jacket for baseball of claim 1, wherein the jacket body is of a pullover type, and the cover sheet is of an endless circular type.

8. The jacket for baseball of claim 1, wherein the cover sheet shrinks in the circumferential direction in a natural state and resiliently fastens a trunk portion of a body in a state where the cover sheet is worn on the body.

9. A jacket for baseball comprising:

a jacket body; and a cover sheet having an upper end attached to an inside of at least a front part of a lower portion of the jacket body, wherein the jacket body and the cover sheet are constituted so that a waist belt of bottoms for baseball can be located on a region from an attaching portion for the cover sheet of the lower portion of the jacket body to a hem of the jacket body in a vertical direction of the jacket body and between an inside face of the lower portion of the jacket body and an outside face of the cover sheet.

* * * * *